US008499886B2

(12) United States Patent
Johnston et al.

(10) Patent No.: US 8,499,886 B2
(45) Date of Patent: Aug. 6, 2013

(54) EXPANDER EAR TIP

(75) Inventors: Timothy Johnston, Los Gatos, CA (US); Jacob Meyberg, Santa Cruz, CA (US); Eric Bradford, Aptos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 13/273,553

(22) Filed: Oct. 14, 2011

(65) Prior Publication Data

US 2013/0092470 A1 Apr. 18, 2013

(51) Int. Cl.
*H04R 25/02* (2006.01)
*H04R 25/00* (2006.01)

(52) U.S. Cl.
USPC ..... 181/129; 381/328; 381/329; 181/135

(58) Field of Classification Search
USPC ..... 181/129, 130, 135; 381/23.1, 312, 381/322, 324, 328, 329, 380, 383, 385
See application file for complete search history.

(56) References Cited

U.S. PATENT DOCUMENTS

| | | | | | |
|---|---|---|---|---|---|
| 2,053,995 | A * | 9/1936 | Hoey | 128/865 |
| 2,719,523 | A * | 10/1955 | Von Gierke | 128/864 |
| 3,800,791 | A * | 4/1974 | Visor | 128/864 |
| 4,060,080 | A * | 11/1977 | Akiyama | 128/865 |
| 4,133,984 | A * | 1/1979 | Akiyama | 381/328 |
| 4,539,440 | A * | 9/1985 | Sciarra | 381/329 |
| 4,896,679 | A * | 1/1990 | St. Pierre | 128/865 |
| 4,913,165 | A * | 4/1990 | Fishgoyt | 128/865 |
| 4,965,838 | A * | 10/1990 | Kamon et al. | 381/380 |
| 4,981,194 | A * | 1/1991 | Kamon et al. | 181/129 |
| 5,048,092 | A * | 9/1991 | Yamagishi et al. | 381/380 |
| 5,483,027 | A * | 1/1996 | Krause | 181/135 |
| 5,544,253 | A * | 8/1996 | Nagayoshi et al. | 381/385 |
| 6,094,494 | A * | 7/2000 | Haroldson | 381/328 |
| 6,256,396 | B1 * | 7/2001 | Cushman | 381/328 |
| 6,731,772 | B1 * | 5/2004 | Byun | 381/380 |
| 7,362,875 | B2 * | 4/2008 | Saxton et al. | 381/322 |
| 7,478,702 | B2 * | 1/2009 | Berg et al. | 181/135 |
| 7,664,287 | B2 * | 2/2010 | Neu et al. | 381/381 |
| 7,720,244 | B2 * | 5/2010 | Espersen et al. | 381/330 |
| 7,778,434 | B2 * | 8/2010 | Juneau et al. | 381/328 |
| 7,886,745 | B2 * | 2/2011 | Purcell et al. | 128/864 |
| 7,913,696 | B2 * | 3/2011 | Purcell et al. | 128/864 |
| 8,031,894 | B2 * | 10/2011 | Perkins et al. | 381/328 |
| 8,059,845 | B2 * | 11/2011 | Bryant | 381/324 |
| 8,116,501 | B2 * | 2/2012 | Kusuda et al. | 381/380 |
| 8,194,910 | B2 * | 6/2012 | Uchida et al. | 381/370 |
| 8,270,649 | B2 * | 9/2012 | Semcken | 381/329 |
| 2004/0215053 | A1 * | 10/2004 | Jorgensen et al. | 600/25 |
| 2005/0247515 | A1 * | 11/2005 | Berg | 181/135 |
| 2008/0181444 | A1 * | 7/2008 | Bryant | 381/380 |
| 2008/0264428 | A1 * | 10/2008 | Purcell et al. | 128/864 |
| 2009/0028356 | A1 * | 1/2009 | Ambrose et al. | 381/71.6 |
| 2009/0071487 | A1 * | 3/2009 | Keady | 128/864 |
| 2009/0116677 | A1 * | 5/2009 | Jones et al. | 381/380 |

(Continued)

FOREIGN PATENT DOCUMENTS

JP 62274900 A * 11/1987

*Primary Examiner* — Edgardo San Martin
(74) *Attorney, Agent, or Firm* — Chuang Intellectual Property Law

(57) ABSTRACT

Methods and apparatuses for wearing audio products are disclosed. In one example, an apparatus for delivering sound to an ear includes a flexible material shaped to fit within an outer ear. The apparatus includes a movable member in contact with an inner surface of the flexible material, the flexible material configured to expand or retract responsive to movement of the member.

21 Claims, 11 Drawing Sheets

U.S. PATENT DOCUMENTS

2009/0173353 A1* 7/2009 Purcell et al. ..... 128/865
2010/0002897 A1* 1/2010 Keady ..... 381/328
2010/0012420 A1* 1/2010 Keady ..... 181/135
2010/0239114 A1* 9/2010 Wada ..... 381/380
2011/0019851 A1* 1/2011 Michel et al. ..... 381/326
2011/0079227 A1* 4/2011 Turcot et al. ..... 128/865

* cited by examiner

EXPANDER EAR TIP

BACKGROUND OF THE INVENTION

Various audio products exist in which a receiver is placed in the user's ear. For example, "in-the-ear" headsets, also referred to as ear tip, ear bud, or concha style headsets are devices for transmitting received sounds to the ear of the user by means of a small receiver which is sized to fit in the lower concha in front of the ear canal. In telecommunication headsets, a voice tube is often coupled to the receiver and extends down and towards the user's mouth for receiving the user's voice and transmitting it over a telecommunications line. Conventional ear tip style headsets position the receiver inside the lower concha between the tragus and anti-tragus to establish placement and support on the ear.

However, most audio products that are intended to be worn on the ear tend to be unstable when worn. Different ear shapes and sizes make it difficult for a single design to both fit the ear comfortably and to properly stabilize the headset. Minor size and shape variations of the concha of individual users results in instability for users whose concha do not hold the headset with sufficient force or discomfort to those with smaller concha.

As headsets and headphone designs continue to get smaller and lighter, the in-the-ear wearing style is becoming more popular. In previous implementations, the device is often shipped with different sized ear loops and ear tips. This presents several problems, including the added cost of the several ear loops and car tips.

The user is limited to finite ear piece diameters and shapes, often having to use trial by error to determine which of a selection of several provides the best fit, comfort, and stability. Even with multiple options, the user may still find a less than optimal fit. Or, for lower-priced devices, the user may be limited to a single ear tip the device is provided with and is forced to live with a less than optimal fit.

As a result, there is a need for improved methods and apparatuses for fitting audio products.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1A:
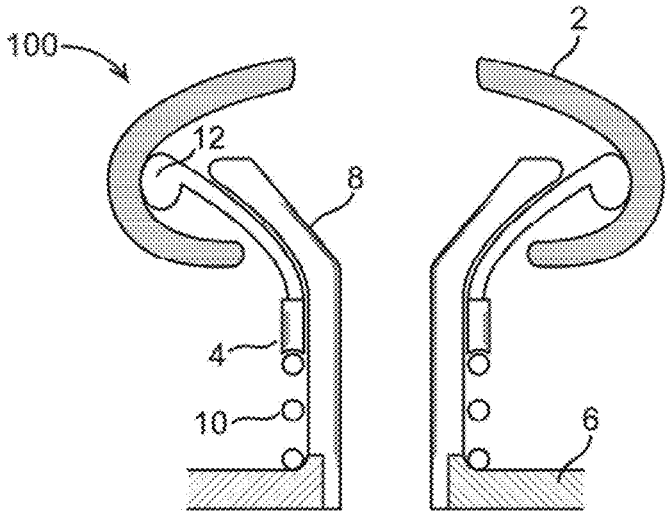
FIGS. 1A and 1B illustrate diagrams of an apparatus for delivering sound to an ear in an expanded and contracted position, respectively, in one example.

Methods and apparatuses for audio devices are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

In one example, apparatuses and methods are presented herein for a one-device-fits-all, comfortable, conforming and stable ear tip apparatus. The apparatus may be utilized with in-the-ear devices used for audio receive, such as headsets and headphones.

The present invention is applicable to a variety of different types of devices in addition to communication headsets, including stereo listening headsets and any other devices designed to deliver sound to the car canal. While the present invention is not necessarily limited to such devices, various aspects of the invention may be appreciated through a discussion of various examples using this context.

In one example, an ear tip (also referred to as an "earbud") is adjustable, either automatically or manually by a user. For example, the ear tip has an adjustable diameter size. No pieces need to be added removed in order for the diameter be adjusted. The ear tip can be fitted to various ear cavum sizes for comfortable wearing and a secure fit. The ear tip is conformable to the user's outer ear when inserted, and provides an acoustic seal when inserted and sized. The ear tip provides excellent audio quality as a result of the acoustic seal.

In one example, an ear tip utilizes spring-loaded fingers. A spring achieved with included features within the headset housing (e.g., a receiver neck or collar), or a separate spring, forces the fingers away from a capsule unit. This feature or features within the receiver neck are ramped in a fashion that requires the fingers to expand as they move away from the capsule. A flexible and stretchy ear tip, possibly made of an elastomeric material, is held to the ends of the fingers. In a further example, extender (also referred to herein as "extension") pieces are attached to or movable by the end of the fingers against the ear tip. Therefore, as the spring extends and presses a finger unit to which the fingers are attached, the fingers move away from the capsule, expanding the ear tip to a maximum diameter. When the device's ear tip presses into the ear canal, the finger unit moves toward the capsule, compressing the spring thereby decreasing the diameter of the ear tip until it easily depresses into the ear canal.

As the ear tip bottoms out into the ear canal, the user ceases to apply an inward force and the capsule spring pushes the fingers outward until the ear tip has increased its diameter to the point of a snug fit. Removal of the device requires the user to pull the ear tip to overcome the frictional fit. This approach allows for switching form one ear to another without any required adjustment; it contracts and re-expands each time. The sizing of the ear tip accommodates variations in concha and ear size and ensures adequate holding pressure within the concha after placement in the user ear.

In one example, a finger unit extends or retracts fingers based on user rotation of an ear tip apparatus, thereby expanding or contracting the ear tip from a smaller to a larger diameter and back again as the unit is turned one way or the other. When the device is placed into the ear canal, the user can adjust the size of the ear tip by turning it to get the precise and comfort fit, as snug as desired. Once set, the ear tip will remain in set position for future wearing or removal. If the user so chooses to tighten or loosen the fit for improvements in stability or changing form one ear to another, a simple adjustment of the ear piece can be achieved.

In one example, a rotatable cam unit is used instead of the finger unit. The rotatable cam unit includes several cams, each of which press against an inner surface of an extender piece having a plurality of cam detents of varying depth. The outer surface of each extender piece is pressed against the inner surface of the ear tip. As the cam unit is rotated, a cam moves from one extender piece cam detent to the next. Since each cam detent is of varying depth, rotation of the cam extends the extender piece a different distance against the ear tip. The cam unit extends or retracts the extenders based on user rotation, thereby expanding or contracting the ear tip as the apparatus is turned one way or the other.

In one example, the fingers or extenders extend or retract together a uniform distance. In a further example, individual fingers or extenders extend against the ear tip a different distance with respect to one another. For example, in one example, the ends of fingers or extenders are staggered in distance with respect to one another. This allows for a staggered start of expansion in the radial direction for each finger or extender. Rather than a uniform circular expansion, the staggered points of expansion allow the ear tip to expand into shapes which may be more like the typical ear concha.

In one example, a stabilizer loop of the ear tip changes shape as the ear tip expands and changes circumference if attached at more than one point on the ear tip circumference. The change in geometry may help better fit a range of ear sizes.

The apparatuses and methods described herein allow for an easy and intuitive approach to headset or headphone fitting to the ear which results in a more consistent ear coupling. This improved coupling to the ear allows for further receive tuning advancements and device stability in the ear. This may result in a better fit on a larger portion of the population.

In one example, an apparatus for delivering sound to an ear includes a flexible material shaped to fit within an outer ear. The apparatus includes a movable member in contact with an inner surface of the flexible material, the flexible material configured to expand or retract responsive to movement of the member.

In one example, a headset includes a housing component arranged to output audio from a receiver and a resilient ear tip dimensioned to cover a portion of the housing component and arranged to deliver audio from the receiver to an ear. The headset includes an ear tip adjuster configured to alter the size or shape of the ear tip.

In one example, a method for optimizing fit of an ear tip in an ear includes decreasing a size of an ear tip during insertion of the ear tip into an ear to a desired position, and increasing the size of the ear tip following completion of insertion to the desired position, wherein the size of the ear tip is automatically increased to adapt to the size of the user ear.

Figure 1B:
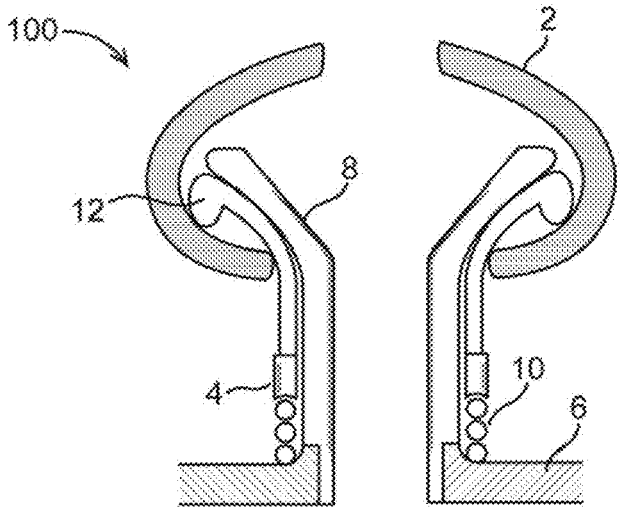

FIGS. 1A and 1B illustrate diagrams of an apparatus 100 for delivering sound to an ear in an expanded and contracted position, respectively, in one example. The apparatus 100 for delivering sound to an ear includes a flexible material 2 shaped to fit within an outer ear (hereinafter also referred to as an ear tip). In one example, the flexible material 2 is operable as a cushion, and may define a substantially toroidal shape.

The apparatus 100 includes a movable member 4 in contact with an inner surface of the flexible material 2, the flexible material 2 configured to expand or retract responsive to movement of the movable member 4. In one example, the movable member 4 is a plastic material. In one example, as shown in FIG. 1A and FIG. 1B, the movable member 4 includes a plurality of member fingers 12 in contact with the inner surface of the flexible material 2, the plurality of member fingers 12 configured to extend or retract. The apparatus includes a spring 10, where the movable member 4 is spring-loaded with spring 10. Ear tip 2 includes an aperture 3 for delivery of sound to the user ear.

To achieve the expansion and compression characteristics of the ear tip 2 herein described, the ear tip 2 is composed of a soft, elastic or elastomeric material. In one example, the material selected is non-porous. For example, ear tip 2 may be constructed from a compressible, conformable, and resilient material. Suitable materials include elastomers, foam, and air-filled injection molded materials or cast materials. The elastomer may be sponge-like, filled with air pockets to enhance compressibility. The ear tip 2 may be fabricated by a variety of conventional methods including casting, compression molding, and injection molding.

In operation, the movable member 4 is configured to retract the flexible material 2 during insertion of the apparatus into the outer ear and expand the flexible material 2 upon completion of insertion. In one example, the movable member 4 is adapted to move in a designated direction responsive to contact with a headset housing 6 component. For example, as shown in FIGS. 1A and 1B, fingers 12 are in contact with a collar 8 of headset housing 6. In this example, collar 8 is funnel shape, having angled walls at a distal end from the main headset body. In operation, fingers 12 slide outward responsive to sliding against collar 8 towards flexible material 2 when spring 10 is expanding or expanded as shown in FIG. 1A. Similarly, fingers 12 are retracted along collar 8 away from flexible material 2 when spring 10 is compressed as shown in FIG. 1B.

Figure 4:
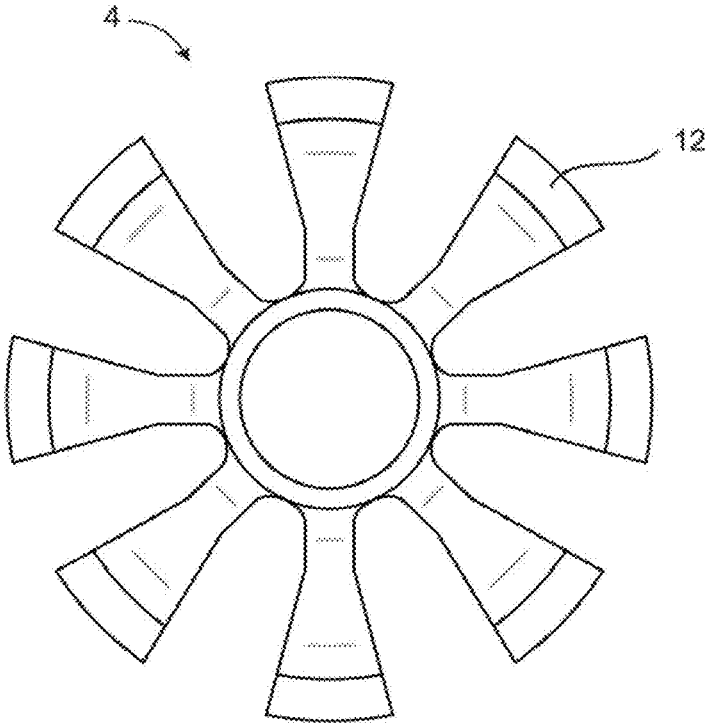
FIG. 4 illustrates a top view of the fingers utilized to expand and retract an ear tip as shown in FIGS. 1-3 in one example.

In one example, where flexible material 2 forms an ear tip, the method optimizes fit of the ear tip in an ear by decreasing the size of the ear tip during insertion into an ear to a desired position, and increasing the size of the ear tip following completion of insertion to the desired position, where the size of the ear tip is automatically increased to adapt to the size of the user ear. In one example, decreasing the size of the ear tip is responsive to a first spring action by spring 10 resulting from insertion of the ear tip into the ear and increasing the size of the ear tip is responsive to a second spring action by spring 10 opposite the first spring action resulting from release of the ear tip at the desired position. FIG. 4 illustrates a top view of the movable member 4 having fingers 12 utilized to expand and retract an ear tip in one example.

Upon release by the user following insertion, the ear tip 2 expands to fill the lower concha responsive to the action of the spring 10, conforming to the individual user's lower concha and forming a tight fit within the user ear. The tight fit of the ear tip 2 within the ear creates excellent acoustic sealing that excludes ambient noise and provides superior sound quality and also reduces echo between receiver and microphone.

The adjustability of the size or shape of the ear tip 2 accommodates variations in concha and ear size and ensures adequate holding pressure within the concha after placement in the user ear. The adjustability of the size of the ear tip 2 prevents it from rotating within the user concha or being easily dislodged and falling out of the concha, greatly enhancing stability in the ear and reducing the possibility that the weight of the headset may dislodge the ear tip, particularly during movement.

Figure 2A:
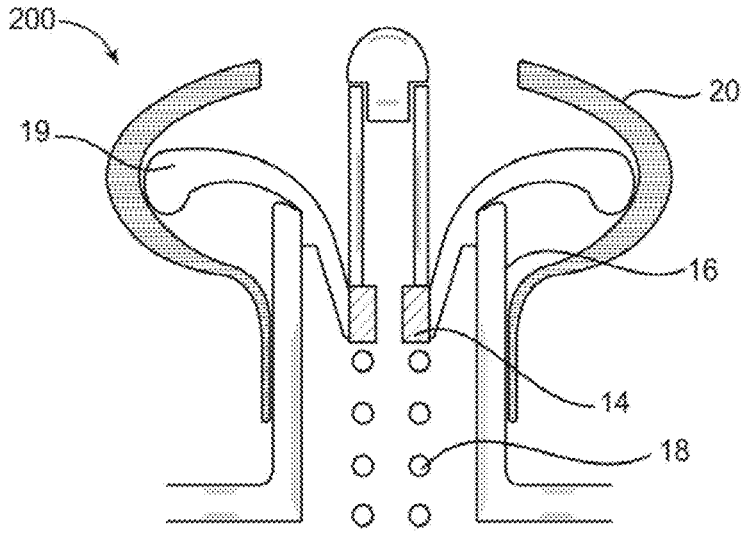
FIGS. 2A and 2B illustrate diagrams of an apparatus for delivering sound to an ear in an expanded and contracted position, respectively, in a further example.
Figure 2B:
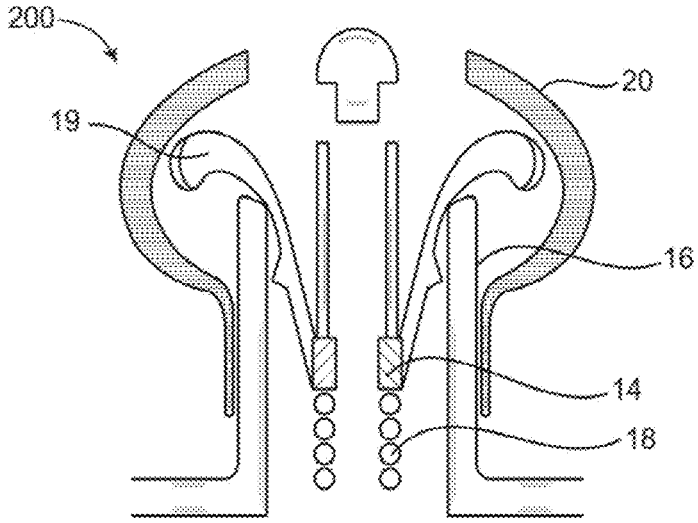
Figure 3:
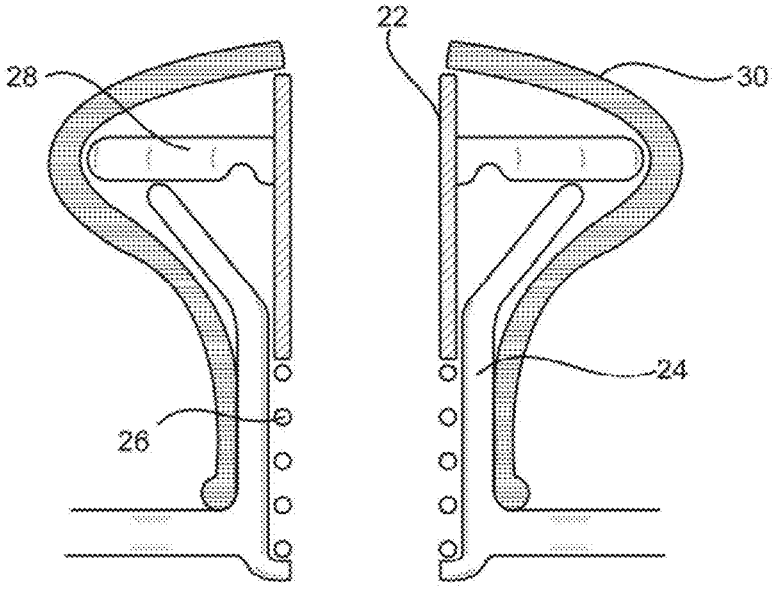
FIG. 3 illustrates a diagram of an expander ear tip in an expanded position in a further example

The spatial arrangement between movable member 4 and collar 8 may vary. As shown in FIGS. 1A and 1B, movable member 4 and spring 10 are disposed substantially outside of collar 8. FIG. 3 illustrates a diagram of an expander ear tip in an expanded position in a further example. In the example shown in FIG. 3, a spring 26 and a movable member 22 having fingers 28 extendible against a flexible material (e.g., an ear tip) are disposed substantially inside of a collar 24. Furthermore, the shape of the collar may vary. For example, collar 8 and collar 24 shown in FIGS. 1A, 1B, and 3 are funnel shaped. FIGS. 2A and 2B illustrate diagrams of an apparatus for delivering sound to an ear in an expanded and contracted position, respectively, in a further example. In FIGS. 2A and 2B, a cylindrical collar 16 with vertical sides is utilized. In the example shown in FIGS. 2A and 2B, an apparatus 200 including a spring 18 and a movable member 14 having fingers 19 extendible against a flexible material 20 (e.g., an ear tip) are disposed substantially inside of collar 16.

Figures 5A, 5B:
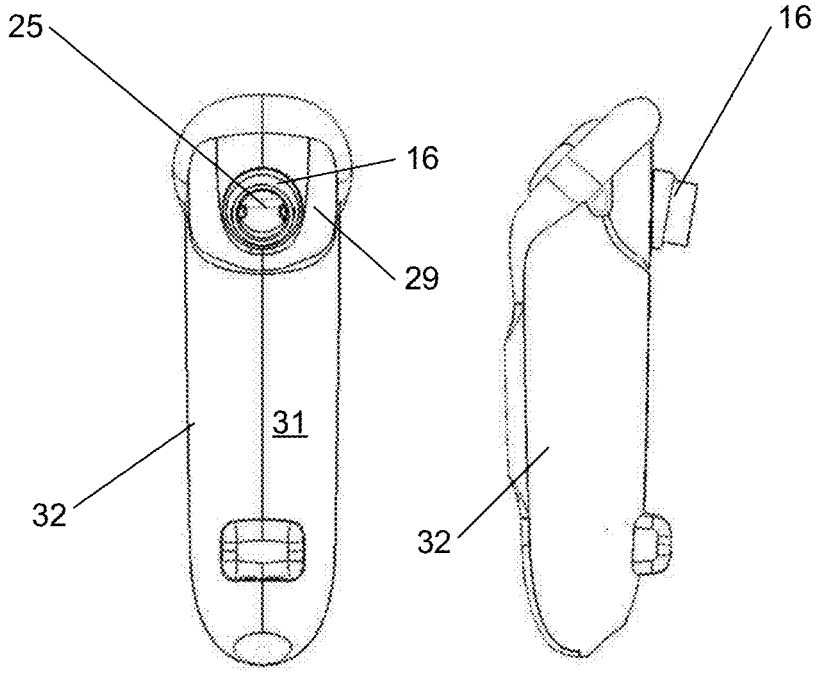
FIG. 5A illustrates a top view of an inner side of a headset having an ear tip collar in one example.
FIG. 5B illustrates a side view of the headset shown in FIG. 5A.
Figure 6:
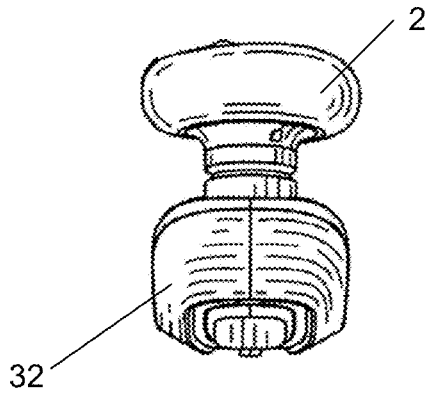
FIG. 6 illustrates an end view of a headset having the expander ear tip attached in one example.

FIG. 5A illustrates a front view of a headset 32 having a collar 16 in one example. FIG. 5B illustrate a side view of the headset 32. Collar 16 includes a port 25 for receiving sound from the headset receiver 29. FIG. 6 illustrates an end view of the headset 32 having an ear tip 2 attached.

Collar 16 is arranged to output audio from the receiver 29. The resilient ear tip 2 is dimensioned to cover at least a portion of the collar 16 and arranged to deliver audio from the receiver 29 to an ear via an aperture in ear tip 2. In one example, the ear tip 2 operates as an ear cushion. The headset 32 includes an ear tip adjuster configured to alter the size or shape of the ear tip 2. For example, the ear tip adjuster includes a movable member of varying embodiment in contact with an inner surface of ear tip 2 as shown and described above in reference to FIGS. 1-4 or the ear tip adjuster has a structure and function as described in FIGS. 7-18 described below.

For example, the ear tip adjuster is adapted to move in a designated direction responsive to contact with the collar 16. The ear tip adjuster may be disposed substantially within or outside the collar 16. In one example, the ear tip adjuster is configured to automatically retract the ear tip 2 during insertion into the ear and expand the ear tip 2 upon completion of insertion. In a further example, the user manually adjusts the ear tip adjuster to a desired size or shape prior to insertion or after insertion. In this manner, the ear tip 2 formed from a soft, resilient and malleable material is advantageously adjusted for personalized custom fit and long term wearing comfort, allowing the ear tip 2 to be sized to optimally deform and adapt to the shape of the lower concha, and thereby maintain the receiver output firmly capsule in position.

The ear tip adjuster may include a plurality of member fingers in contact with an inner surface of the ear tip 2, the plurality of member figures configured to extend or retract. For example, one or more of the plurality of member fingers are arranged to extend against the ear tip 2 a different distance or different rate in relation to one or more of the other plurality of member fingers. In a further example, each member finger includes an attached extension, wherein the attached extension contacts the inner surface of the ear tip 2. Ear tip 2 may be hollow. In this manner, the shape of the ear tip 2 may be expanded in one direction more than another in order to better conform to the user outer ear. In one example, the headset further includes a spring, where the ear tip adjuster is spring-loaded.

In one example, the ear tip adjuster includes a plurality of extenders, each extender having an outer surface to contact the ear tip 2. In a further example, the ear tip adjuster further includes a rotatable cam unit, where at least one extender of the plurality of extenders includes an inner surface having two or more detent depressions configured to receive a cam such that an extender position against the ear tip 2 is responsive to the placement of the cam in a selected detent depression.

Figure 7:
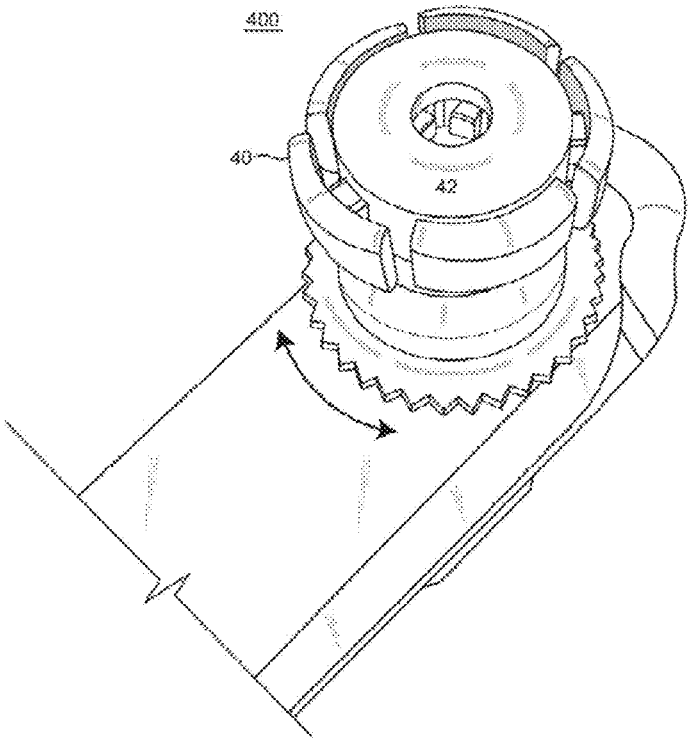
FIG. 7 illustrates an alternative example of an expander ear tip device in an expanded position where the outer ear tip has been removed.

FIG. 7 illustrates an alternative example of an expander ear tip device 400 in an expanded/extended position where the outer ear tip has been removed. As shown in FIG. 7, a plurality of extenders 40 extend from a central body 42. In operation, extenders 40 contact an inner surface of the ear tip, and extend and retract to alter the size of shape of the ear tip. In one example, the extenders 40 extend or retract from central body 42 an equal distance. In one example, each extender extends against the ear tip a different distance or different rate in relation to one or more of the extenders. In this manner, the shape of the ear tip may be advantageously expanded in one direction more than another in order to better conform to the user outer ear since the shape of the lower concha is neither circular nor symmetrical from left to right ears. As shown in FIG. 7, each extender 40 has been extended a different distance from central body 42.

Figure 8:
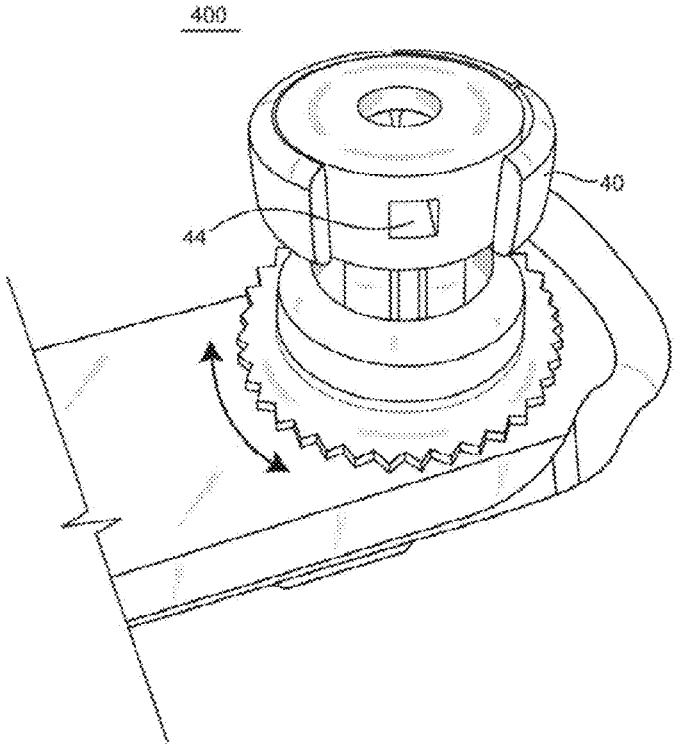
FIG. 8 illustrates the alternative expander ear tip device shown in FIG. 7 in a retracted position.
Figure 9:
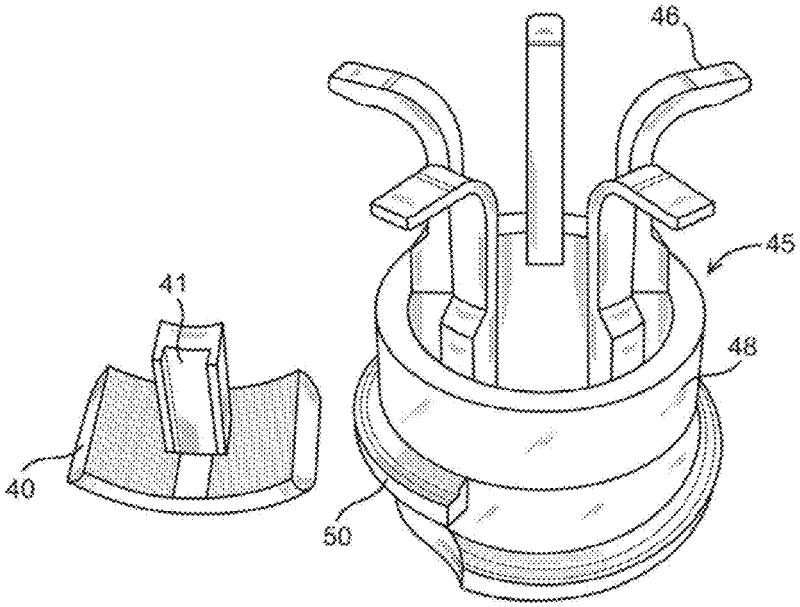
FIG. 9 illustrates the finger unit and an extender utilized by the expander ear tip device shown in FIG. 7.

FIG. 8 illustrates the expander ear tip device 400 shown in FIG. 7 where all of the extenders 40 are in a retracted position. For illustration purposes, one of the extenders 40 has been removed, revealing an aperture 44 through which the extender 40 is attached to or engaged by a movable unit. FIG. 9 illustrates a finger unit 45 and an extender 40 utilized by the expander ear tip device 400 in one example of FIGS. 7 and 8. Finger unit 45 includes a body 48 having screw thread 40 and a plurality of fingers 46. Extender 40 includes a connector 41 for attachment to a finger 46 through aperture 44.

In one example, the extenders 40 are separate pieces from the fingers 46 and coupled to the ends of fingers 46. One of ordinary skill will recognize that a variety of mechanisms by which fingers 46 engage extenders 40 may be used in order to allow fingers 46 to extend extenders 40 outward and/or retract extenders 40 inward. In one example, a gap between the extender 40 and finger 46 can be designed so that each extender 40 will be engaged at different points or times as a threaded collar pushes the flexible finger 46 into the extender 40. In this manner, an extender 40 will extend a different amount as shown in FIG. 7.

Figure 10:
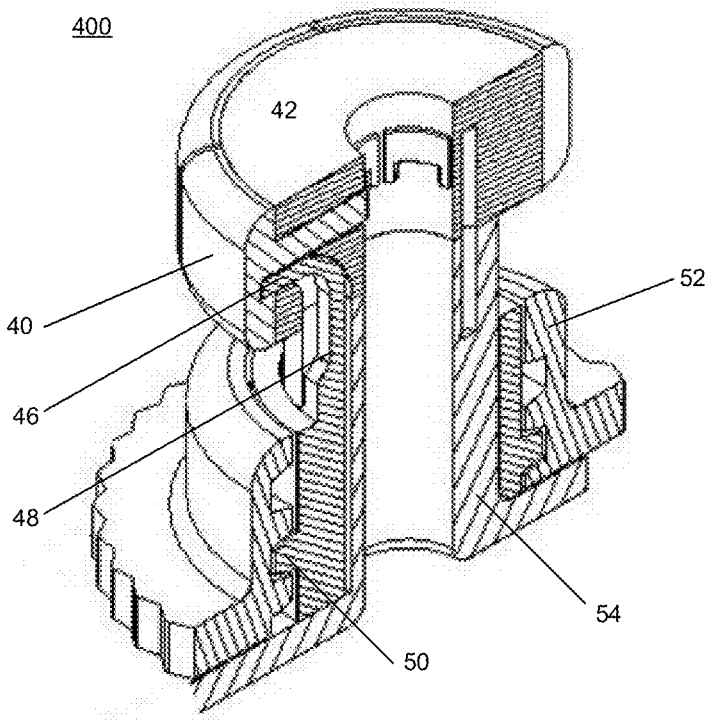
FIG. 10 illustrates a cross-sectional diagram of the expander ear tip device shown in FIG. 7
Figure 11:
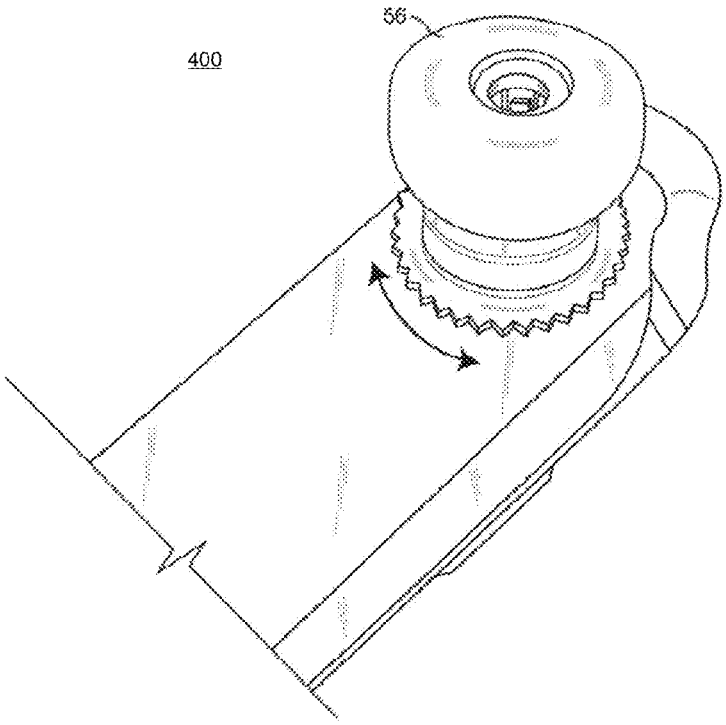
FIG. 11 illustrates the expander ear tip device shown in FIG. 7 in a contracted position with the ear tip in place.
Figure 12:
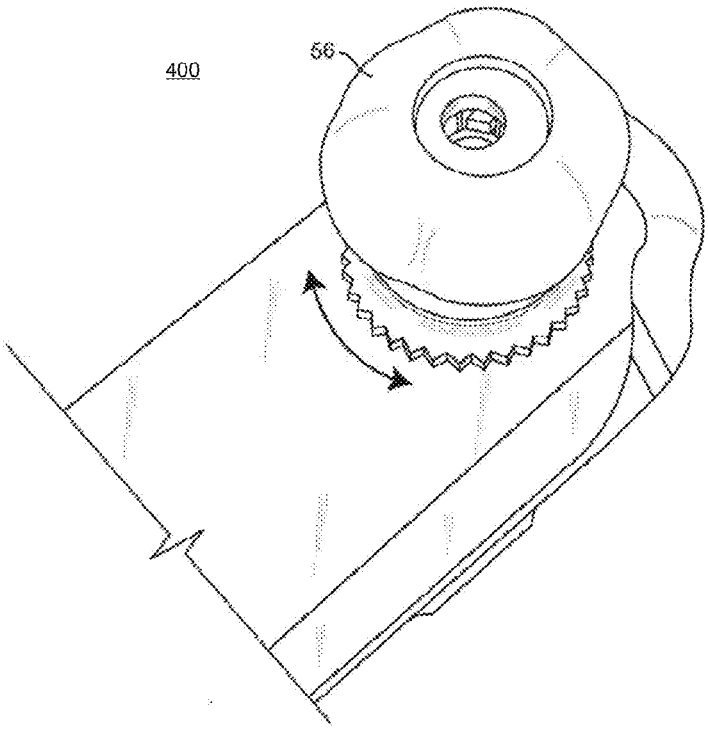
FIG. 12 illustrates the expander ear tip device shown in FIG. 7 in an expanded position with the ear tip in place.

FIG. 10 illustrates a cross-sectional diagram of the expander ear tip device 400 shown in FIG. 7 attached to a headset housing 54. Body 48 is threaded utilizing thread 50 into a corresponding mating body 52 having receiving threads. Central body 42 is affixed to the headset housing 54 collar. In operation, as body 52 is rotated about the headset collar, extenders 40 either extend or retract based upon movement of body 48 within body 52. FIG. 11 illustrates the expander ear tip device 400 shown in FIG. 7 in a contracted position with an ear tip 56 in place. FIG. 12 illustrates the expander ear tip device 400 shown in FIG. 7 in an expanded position with the expanded ear tip 56 in place.

Figure 13:
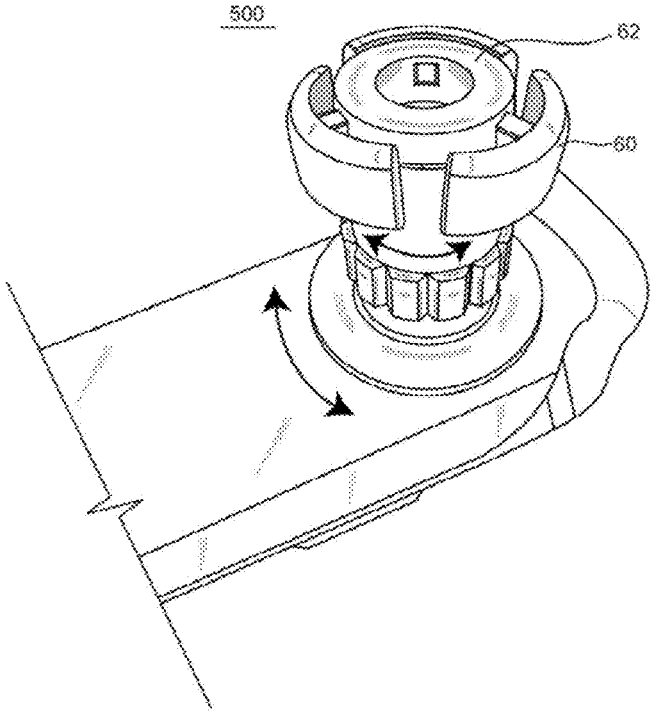
FIG. 13 illustrates a further alternative example of an expander ear tip device in an expanded position where the outer ear tip has been removed.
Figure 14:
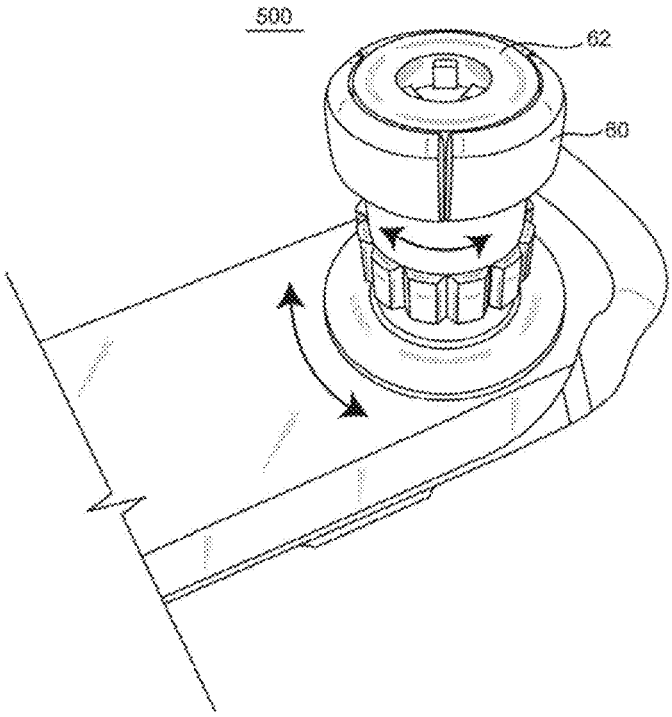
FIG. 14 illustrates the alternative expander ear tip device shown in FIG. 13 in a retracted position.

FIG. 13 illustrates a further alternative example of an expander ear tip device 500 in an expanded position where the outer ear tip has been removed. As shown in FIG. 13, a plurality of extenders 60 extend from a central body 62. In operation, extenders 60 contact an inner surface of the ear tip, and extend and retract to alter the size of shape of the ear tip. In one example, the extenders 60 extend or retract from central body 62 an equal distance. In one example, each extender extends against the ear tip a different distance or different rate in relation to one or more of the other extenders. In this manner, the shape of the ear tip may be expanded in one direction more than another in order to better conform to the user outer ear. As shown in FIG. 13, each extender 60 has been extended a different distance from central body 62. FIG. 14 illustrates the expander ear tip device 500 shown in FIG. 13 where all of the extenders 60 are in a retracted position.

Figure 15:
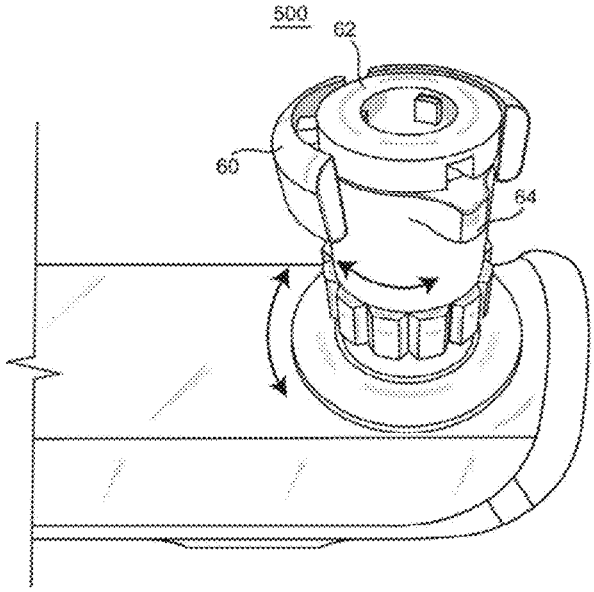
FIG. 15 illustrates the alternative expander ear tip device shown in FIG. 13 where an extender has been removed to show a cam.
Figure 16:
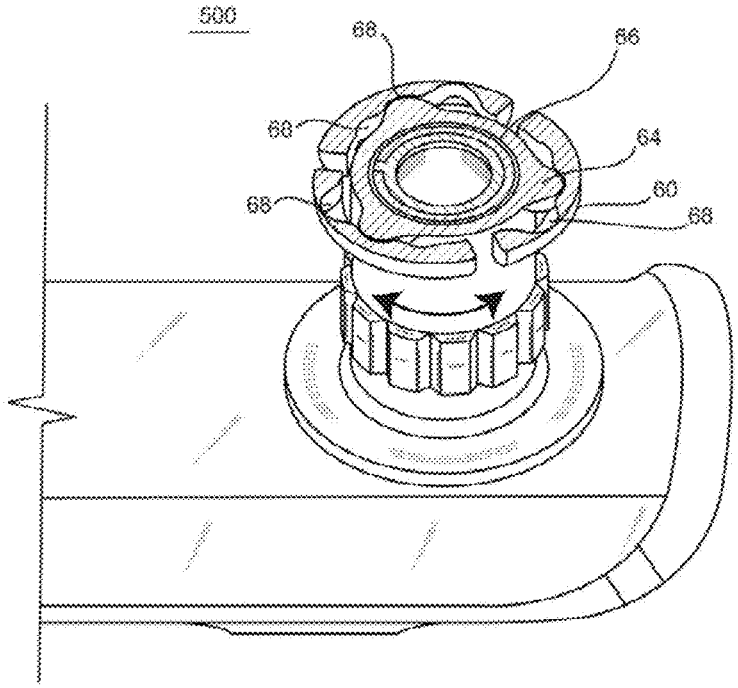
FIG. 16 illustrates a cut-away view of the expander ear tip device shown in FIG. 13.

FIG. 15 illustrates the expander ear tip device 500 shown in FIG. 13 where an extender 60 has been removed to show a cam 64. FIG. 16 illustrates a cut-away view of the expander ear tip device 500 shown in FIG. 13. Each extender 60 includes an inner surface having two or more detent depressions 68 configured to receive a cam 64. Each detent depression 68 is of varying depth such that an extender 60 extension position against the ear tip is responsive to the placement of the cam in a selected detent depression for each rotational step. For example, a shallower depression 68 will produce a greater extension distance against the ear tip. Each cam 64 is attached to a rotatable cam unit 66. This design allows each extender to expand to different non-uniform radial positions with each step, allowing the ear tip to expand into shapes which may be more like the typical ear concha.

In operation, as cam unit 66 is rotated about the headset collar, extenders 60 either extend or retract based upon movement of the individual cams 64 within the detent depressions.

Figure 17:
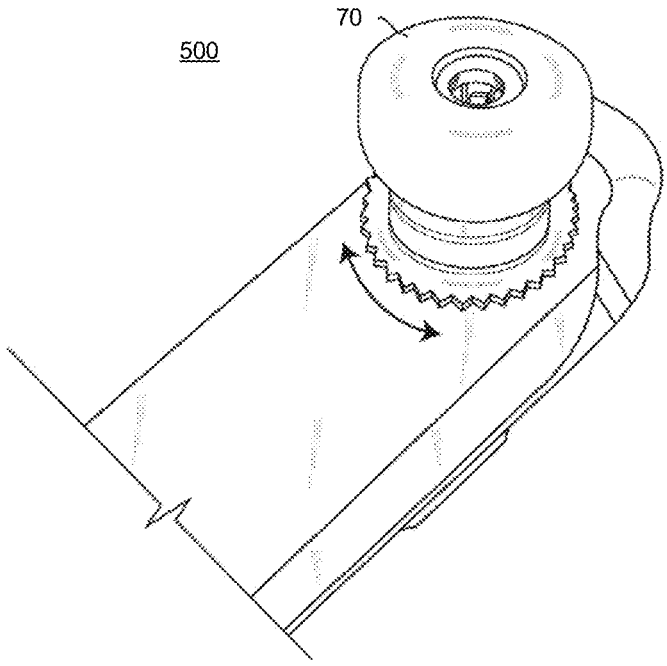
FIG. 17 illustrates the expander ear tip device shown in FIG. 13 in a contracted position with the ear tip in place.
Figure 18:
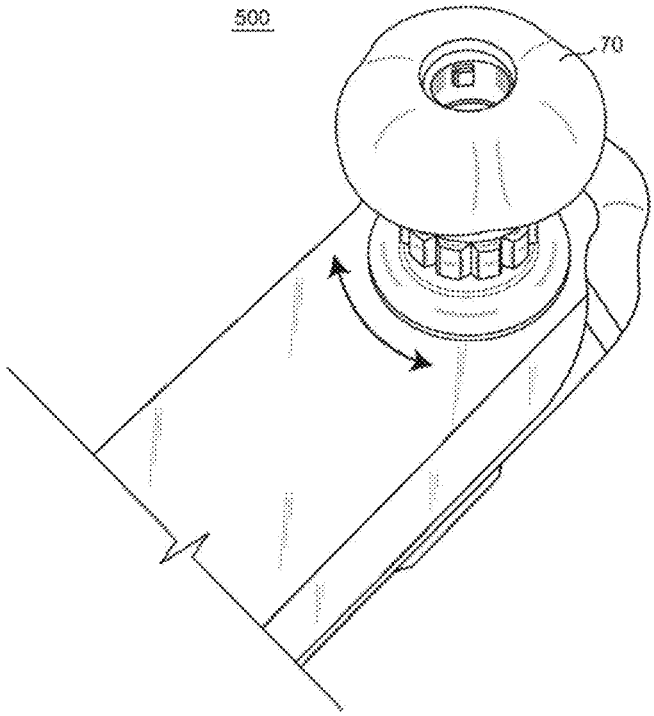
FIG. 18 illustrates the expander ear tip device shown in FIG. 13 in an expanded position with the ear tip in place.

FIG. 17 illustrates the expander ear tip device 500 shown in FIG. 13 in a contracted position with an ear tip 70 in place. FIG. 18 illustrates the expander ear tip device 500 shown in FIG. 13 in an expanded position with the expanded ear tip 70 in place.

Figure 19:
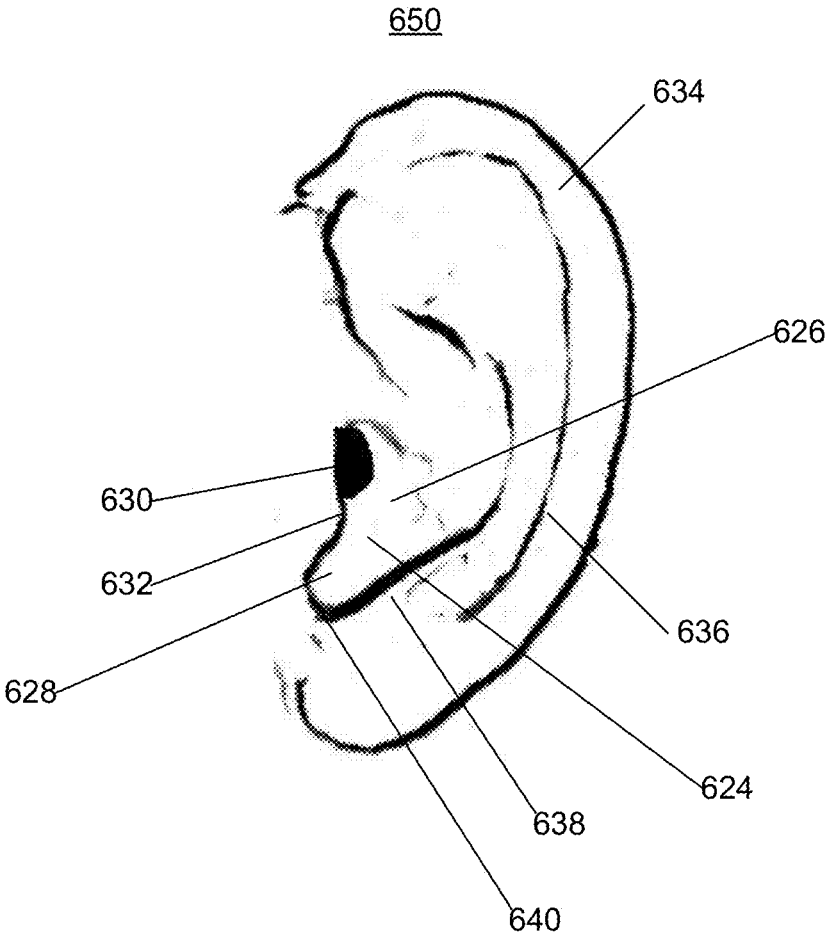
FIG. 19 illustrates a human ear.

FIG. 19 illustrates a typical human ear 650 having various parts as described herein. The outer ear, or pinna, is an irregularly concave cartilaginous member comprised of a number of eminences and depressions which give each ear a distinct shape and form. The helix 634 is the curved outer rim of the ear; below the helix 634 is the anti-helix 636, a curved prominence which describes a curve around the concha cavum 624, a deep cavity containing the entry to the ear canal 630. The concha cavum 624 is divided into two parts, the upper concha 626 and lower concha 628, by the crux of the helix 634 which curves around the outside of the ear, and extends inwards at about the vertical midpoint of the ear. The upper concha 626 lies above the crux of the helix 634 and below the anti-helix 636; the lower concha 628 lies below the crux of the helix 634 and surrounds the entry to the ear canal 630. In front of the lower concha 628 and projecting backwards from the front of the ear is the tragus 632, a small semicircular prominence. Opposite the tragus 632 and separated from it by the deep curvature of the intertragal notch 640 is the antitragus 638.

While the exemplary embodiments of the present invention are described and illustrated herein, it will be appreciated that they are merely illustrative and that modifications can be made to these embodiments without departing from the spirit and scope of the invention. Such changes may include, but are not necessarily limited to: size of the ear tip and associated sections, material of the ear tip, and mating mechanism with an audio device receiver. Furthermore, the shapes and sizes of the illustrated headset housing and components may be altered. The ear tip can be used with any headset for personal listening to any audio source device. For example, the invention can be used with headsets typically employed for listening to music. Although use of a toroidal shaped section is described in certain examples, other similar shapes including discs, "tire" shaped sections, or other flattened spherical shapes may be used. Illustrations may be simplified for clarity or discussion purposes. Thus, the scope of the invention is intended to be defined only in terms of the following claims as may be amended, with each claim being expressly incorporated into this Description of Specific Embodiments as an embodiment of the invention.

What is claimed is:

1. An apparatus for delivering sound to an ear comprising:

a flexible material shaped to fit within an outer ear;

a movable member in contact with an inner surface of the flexible material, the flexible material configured to expand or retract responsive to movement of the movable member, wherein the movable member comprises a plurality of extenders, each extender having an outer surface to contact the flexible material; and a rotatable cam unit, wherein at least one extender of the plurality of extenders comprises an inner surface having two or more detent depressions configured to receive a cam such that an extender position against the flexible material is responsive to a placement of the cam in a selected detent depression.

2. The apparatus of claim 1, wherein the flexible material comprises an elastomer material, foam material, air-filled injection molded or cast material, or air filled elastomer material.

3. The apparatus of claim 1, wherein the movable member is a plastic material.

4. A headset comprising:

a housing component arranged to output audio from a receiver;

an ear tip dimensioned to cover a portion of the housing component and arranged to deliver audio from the receiver to an ear; and an ear tip adjuster configured to alter a size or shape of the ear tip, wherein the ear tip adjuster comprises a plurality of extenders, each extender having an outer surface to contact the ear tip, and the ear tip adjuster further comprises a rotatable cam unit, wherein at least one extender of the plurality of extenders comprises an inner surface having two or more detent depressions configured to receive a cam such that an extender position against the ear tip is responsive to a placement of the cam in a selected detent depression.

5. The headset of claim 4, wherein the ear tip is hollow.

6. An apparatus for delivering sound to an ear comprising:

an ear tip configured to deliver sound to an ear; and an ear tip adjuster comprising a rotatable unit configured to alter a size or shape of the ear tip responsive to rotation of the rotatable unit, wherein the ear tip adjuster further comprises a plurality of fingers, the plurality of fingers arranged to extend or retract responsive to rotation of the rotatable unit.

7. An apparatus for delivering sound to an ear comprising:

an ear tip configured to deliver sound to an ear; and an ear tip adjuster comprising a rotatable unit configured to alter a size or shape of the ear tip responsive to rotation of the rotatable unit, wherein the rotatable unit comprises a plurality of cams in contact with a plurality of extender pieces.

8. The apparatus of claim 1, wherein the flexible material forms an ear cushion.

9. The apparatus of claim 1, wherein the flexible material defines a substantially toroidal shape.

10. The headset of claim 4, wherein the ear tip comprises an ear cushion.

11. The headset of claim 4, wherein each extender detent depression of the two or more detent depressions vary in depth.

12. The apparatus of claim 1, wherein each extender detent depression of the two or more detent depressions vary in depth.

13. The headset of claim 4, wherein the ear tip comprises an elastomer material, foam material, air-filled injection molded or cast material, or air filled elastomer material.

14. The apparatus of claim 6, wherein the ear tip comprises an ear cushion.

15. The apparatus of claim 6, wherein the ear tip comprises an elastomer material, foam material, air-filled injection molded or cast material, or air filled elastomer material.

16. The apparatus of claim 6, wherein the ear tip adjuster further comprises a plurality of extenders, wherein each finger of the plurality of fingers engages an extender of the plurality of extenders.

17. The apparatus of claim 16, wherein an extender extends against the ear tip a different distance or at a different rate in relation to one or more of the other extenders in the plurality of extenders.

18. The apparatus of claim 7, wherein the ear tip comprises an ear cushion.

19. The apparatus of claim 7, wherein each extender piece comprises a surface having two or more detent depressions configured to contact a cam, wherein each detent depression of the two or more detent depressions vary in depth.

20. The apparatus of claim 7, wherein each extender piece extends against the ear tip a different distance or at a different rate in relation to one or more of the other extender pieces in the plurality of extender pieces.

21. The apparatus of claim 7, wherein an extender piece of the plurality of extender pieces expands to different non-uniform radial positions against the ear tip responsive to rotation of the rotatable unit.

* * * * *